US012693070B2

(12) United States Patent
Song et al.

(10) Patent No.: US 12,693,070 B2
(45) Date of Patent: Jul. 28, 2026

(54) MICRO-LEAK DETECTION SYSTEM OF RELIQUEFICATION SYSTEM FOR SHIP

(71) Applicant: HANWHA OCEAN CO., LTD., Geoje-Si (KR)

(72) Inventors: Jihoon Song, Siheung-si (KR); Won Jae Choi, Siheung-si (KR); Seung Chul Lee, Seoul (KR)

(73) Assignee: HANWHA OCEAN CO., LTD., Geoje-si (KR)

( * ) Notice: Subject to any disclaimer, the term of this patent is extended or adjusted under 35 U.S.C. 154(b) by 195 days.

(21) Appl. No.: 18/702,180

(22) PCT Filed: Dec. 27, 2021

(86) PCT No.: PCT/KR2021/019916
§ 371 (c)(1),
(2) Date: Apr. 17, 2024

(87) PCT Pub. No.: WO2023/075026
PCT Pub. Date: May 4, 2023

(65) Prior Publication Data

US 2025/0230974 A1 Jul. 17, 2025

(30) Foreign Application Priority Data

Oct. 29, 2021 (KR) ..... 10-2021-0147145

(51) Int. Cl.
*F25J 1/02* (2006.01)
*F25J 1/00* (2006.01)

(52) U.S. Cl.
CPC ..... *F25J 1/0256* (2013.01); *F25J 1/0025* (2013.01); *F25J 1/0277* (2013.01); *F25J 2290/72* (2013.01)

(58) Field of Classification Search
CPC ..... B63B 25/16; B63B 79/10; F25J 1/0025; F25J 1/0256; F25J 1/0262; F25J 1/0277;
(Continued)

(56) References Cited

U.S. PATENT DOCUMENTS 3,828,709 A * 8/1974 Bognaes ..... F17C 13/082 62/53.2
5,004,042 A 4/1991 McMorries, IV et al.
(Continued)

FOREIGN PATENT DOCUMENTS

JP S51-139393 A 12/1976
JP S60-135647 U 9/1985
(Continued)

OTHER PUBLICATIONS

International Search Report and Written Opinion in International PCT Application No. PCT/KR2021/019916 dated Jul. 15, 2022 in 9 pages.
(Continued)

*Primary Examiner* — Filip Zec
(74) *Attorney, Agent, or Firm* — Knobbe, Martens, Olson & Bear, LLP

(57) ABSTRACT

Disclosed herein is a micro-leak detection system of a reliquefaction system for ships. The micro-leak detection system includes: a reliquefaction system reliquefying boil-off gas generated from a liquefied gas stored in a storage tank in a ship by recovering cold heat from the boil-off gas in a heat exchanger, compressing the boil-off gas, and cooling the compressed boil-gas in the heat exchanger through heat exchange with refrigerant circulated along a refrigerant circulation line; a heater heating the boil-off gas to be supplied from the storage tank to the heat exchanger through heat exchange with an antifreeze liquid; and a micro-leak detection device connected to a drain port
(Continued)

through which a remaining liquid is drained from the heater and detecting small leaks in the heater.

7 Claims, 3 Drawing Sheets

(58) Field of Classification Search
CPC .... F25J 2245/02; F25J 2290/72; F17C 13/00; F17C 2221/033; F17C 2223/0161; F17C 2260/038; F17C 2265/036; F17C 2270/0105
See application file for complete search history.

(56) References Cited

U.S. PATENT DOCUMENTS

| | | | | |
|---|---|---|---|---|
| 5,711,270 | A * | 1/1998 | Pedersen | F02M 43/00 123/304 |
| 7,448,223 | B2 * | 11/2008 | Darling, IV | F17C 5/02 62/50.7 |
| 8,943,841 | B2 * | 2/2015 | Lee | F17C 3/025 62/50.1 |
| 10,683,831 | B2 * | 6/2020 | Lee | F02M 21/0245 |
| 10,850,823 | B2 * | 12/2020 | Andoh | B63B 49/00 |
| 11,549,646 | B2 * | 1/2023 | Bernhardt | F25J 1/0277 |
| 11,698,169 | B2 * | 7/2023 | Hodgson | F17C 13/002 62/48.1 |
| 11,752,837 | B1 * | 9/2023 | Peters | F02C 6/00 60/668 |
| 11,796,230 | B1 * | 10/2023 | Vaisman | F25B 9/08 |
| 12,006,017 | B2 * | 6/2024 | Shin | F25J 1/0277 |
| 2003/0106324 | A1 * | 6/2003 | Bishop | F17C 5/06 62/45.1 |
| 2006/0156744 | A1 * | 7/2006 | Cusiter | F17C 7/04 62/53.2 |
| 2007/0028823 | A1 * | 2/2007 | Yang | B63B 25/14 114/74 A |
| 2014/0196474 | A1 * | 7/2014 | Yoo | F25J 1/0221 62/48.1 |
| 2016/0216029 | A1 * | 7/2016 | Ragot | B63B 25/16 |
| 2016/0273709 | A1 | 9/2016 | Olsson et al. | |
| 2018/0320637 | A1 * | 11/2018 | Lee | F25J 1/0201 |

FOREIGN PATENT DOCUMENTS

| | | | |
|---|---|---|---|
| JP | S61-237991 | A | 10/1986 |
| JP | H08-178349 | A | 7/1996 |
| JP | 2010-169330 | A | 8/2010 |
| JP | 2011-080361 | A | 4/2011 |
| JP | 2012-196629 | A | 10/2012 |
| JP | 2020-128707 | A | 8/2020 |
| JP | 2021-507178 | A | 2/2021 |
| KR | 10-2011-0030149 | A | 3/2011 |
| KR | 10-1525664 | B1 | 6/2015 |
| KR | 10-2016-0065788 | A | 6/2016 |
| KR | 10-2016-0099994 | A | 8/2016 |
| KR | 2016-0112824 | A | 9/2016 |
| KR | 10-1722751 | B1 | 4/2017 |
| KR | 10-2018-0033734 | A | 4/2018 |

OTHER PUBLICATIONS

Office Action in KR Application No. 10-2021-0147145 mailed Jun. 26, 2023 in 4 pages.
Extended European Search Report in EP App. No. 21962649.6 dated Oct. 2, 2025.
Notice of Allowance received in Japanese patent application No. 2024-521774 dated Apr. 15, 2025.

* cited by examiner

MICRO-LEAK DETECTION SYSTEM OF RELIQUEFICATION SYSTEM FOR SHIP

TECHNICAL FIELD

The present invention relates to a micro-leak detection system of a reliquefaction system for ships and, more particularly, to a micro-leak detection system which can prevent foreign matter from entering a heat exchanger by detecting small leaks in a heater disposed upstream of the heat exchanger in a reliquefaction system reliquefying boil-off gas generated in a ship.

BACKGROUND ART

Natural gas contains methane as a main component and has been attracting attention as an eco-friendly fuel that emits little or no environmental pollutants during combustion. Liquefied natural gas (LNG) is obtained by liquefying natural gas through cooling to about −163° C. under normal pressure and is suited to long-distance transportation by sea since it has a volume of about 1/600 that of natural gas in a gaseous state. Accordingly, natural gas is stored and transported as liquefied natural gas, which is easy to store and transport.

Since natural gas is liquefied at a cryogenic temperature of −163° C. under normal pressure, LNG storage tanks are typically insulated to maintain LNG in a liquid state. However, despite being insulated, such a storage tank is limited in ability to block external heat. Accordingly, due to external heat continuously transferred to the LNG storage tank, LNG stored in the LNG tank continues to evaporate naturally during transportation, causing generation of boil-off gas (BOG).

Continuous production of boil-off gas in the LNG storage tank increases the internal pressure of the LNG storage tank. If the internal pressure of the storage tank exceeds a predetermined safe pressure, this can cause an emergency situation such as rupture of the storage tank. Accordingly, there is a need to discharge boil-off gas from the storage tank using a safety valve. However, boil-off gas is a kind of LNG loss and is an important issue for transportation efficiency and fuel efficiency of LNG. Therefore, various methods are employed to handle boil-off gas generated in the LNG storage tank.

Recently, a method of using boil-off gas at a fuel demand site such as an engine of a ship, a method of reliquefying boil-off gas and returning the reliquefied boil-off gas to an LNG storage tank, and a method combining these two approaches have been developed and put into use.

DISCLOSURE

Technical Tasks

In a reliquefaction cycle for reliquefaction of boil-off gas generated in a ship, typical available liquefaction methods include a process using a single mixed refrigerant (SMR) cycle and a process using a propane-precooled mixed refrigerant (C3MR) cycle. The C3MR cycle is a process in which natural gas is cooled using propane refrigerant alone and then is liquefied and subcooled using a mixed refrigerant, while the SMR cycle is a process in which natural gas is liquefied using a mixed refrigerant composed of multiple components.

As such, the SMR cycle and the C3MR cycle both use a mixed refrigerant. However, if the composition of the mixed refrigerant changes due to refrigerant loss during liquefaction of boil-off gas, this can lead to poor liquefaction efficiency. Accordingly, there is a need to maintain constant composition of the refrigerant by continuously measuring the composition of the mixed refrigerant and replenishing lacking refrigerant components.

An alternative reliquefaction cycle to reliquefy boil-off gas is a single-cycle liquefaction process using nitrogen refrigerant.

Despite relative inefficiency compared to a reliquefaction cycle using a mixed refrigerant, such a reliquefaction cycle using nitrogen refrigerant is safer due to inert properties of nitrogen refrigerant and is easier to apply to ships since nitrogen refrigerant does not undergo phase change.

A reliquefaction system includes: a compressor receiving and compressing boil-off gas; a heat exchanger cooling the compressed gas from the compressor through heat exchange with refrigerant; and a refrigerant circulation unit through which the refrigerant exchanging heat with the compressed gas in the heat exchanger is circulated. When the reliquefaction system employs a refrigeration cycle using nitrogen refrigerant, the refrigerant circulation unit may be configured such that the refrigerant discharged from the heat exchanger after exchanging heat with the compressed gas is compressed, cooled through the heat exchanger, expanded and cooled again, and circulated to the heat exchanger.

However, introduction of boil-off gas generated from LNG, which is usually at a temperature of about −100° C. and can reach a temperature of −130° C. or less depending on the condition of a storage tank, and nitrogen refrigerant, which is colder than the boil-off gas, can cause thermal stress on the heat exchanger. In particular, if such extremely cold boil-off gas is introduced into the heat exchanger immediately after start-up of the reliquefaction system, that is, when the heat exchanger still remains at room temperature or is not yet sufficiently cooled down, or if the temperature of boil-off gas changes due to changes in condition of the storage tank, thermal stress on the heat exchanger can increase due to increase in temperature difference between the heat exchanger and the boil-off gas, which can lead to damage to the heat exchanger.

In order to solve this problem, the present invention proposes a reliquefaction system that can reduce thermal stress on the heat exchanger while preventing problems such as small leaks and intrusion of foreign matter into the heat exchanger, which can be caused by installation of additional equipment therefor.

Technical Solutions

In accordance with one aspect of the present invention, there is provided a micro-leak detection system of a reliquefaction system for ships, including: a reliquefaction system reliquefying boil-off gas generated from a liquefied gas stored in a storage tank of a ship by recovering cold heat from the boil-off gas in a heat exchanger, compressing the boil-off gas, and cooling the compressed boil-gas in the heat exchanger through heat exchange with a refrigerant circulated along a refrigerant circulation line;

- a heater heating the boil-off gas to be supplied from the storage tank to the heat exchanger through heat exchange with an antifreeze liquid; and
- a micro-leak detection device connected to a drain port through which a remaining liquid is drained from the heater and detecting small leaks in the heater.

Preferably, the micro-leak detection device includes: a connection tube fastened to the drain port and extending downwards therefrom; and a leak detection unit provided to the connection tube to detect the presence of the liquid discharged from the drain port.

Preferably, the micro-leak detection device further includes: a first shut-off valve disposed on the connection tube at an inlet side of the leak detection unit; a second shut-off valve disposed on the connection tube at an outlet side of the leak detection unit; and a tube plug disposed at a lower end of the connection tube.

Preferably, in the micro-leak detection device, the first shut-off valve is operated in a normally open state and the second shut-off valve is operated in a normally closed state, and, during maintenance of the heater, the second shut-off valve is opened to drain the remaining liquid from the heater.

Preferably, the leak detection unit is a sight glass to visually detect the presence of the liquid discharged from the drain port.

Preferably, the leak detection unit is a liquid level detector to detect and measure the liquid discharged from the drain port.

Preferably, the heat exchanger is provided as a cryogenic heat exchanger, and the heater is provided as a shell-tube heat exchanger.

Advantageous Effects

The system according to the present invention allows the temperature of boil-off gas introduced into a heat exchanger to be regulated by a heater disposed upstream of the heat exchanger, and thus can prevent excessive thermal stress on the heat exchanger due to a sudden change upon start-up of a reliquefaction system or upon changes in temperature of the boil-off gas due to changes in condition of a storage tank, thereby preventing damage to the heat exchanger.

In particular, the system according to the present invention can detect small leaks falling within the measurement error range of equipment such as a pressure sensor, thereby preventing intrusion of foreign matter into the heat exchanger, which can occur due to installation of a heater using antifreeze as a working fluid, and thus preventing internal corrosion and reduction in lifespan of the heat exchanger.

EMBODIMENTS

Figure 1:
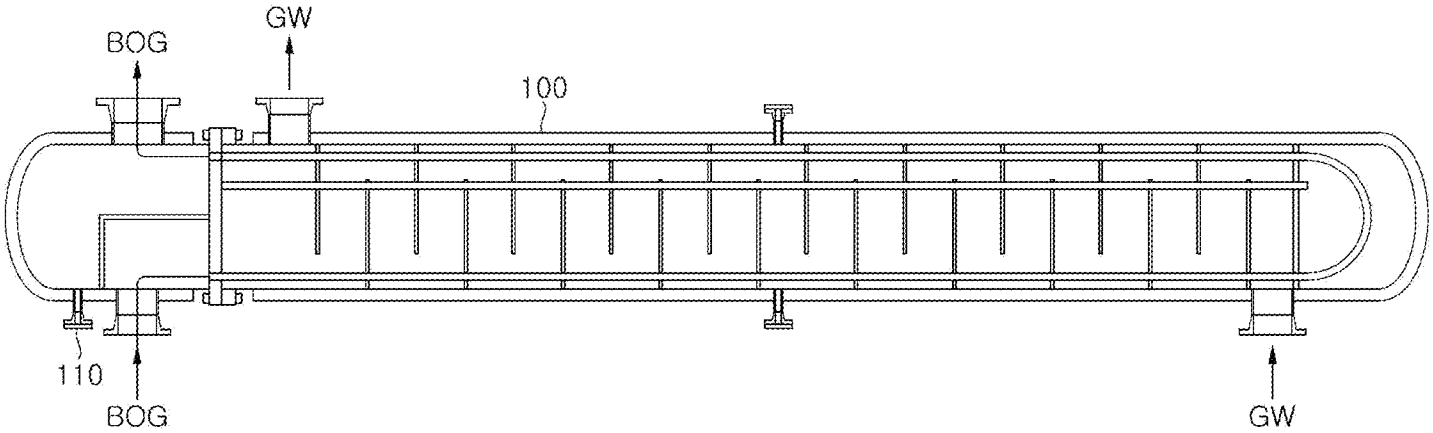
FIG. 1 is a schematic view of a heater of a reliquefaction system for ships, to which a micro-leak detection system according to one embodiment of the present invention is connected.

In order to fully appreciate the operational advantages of the present invention and the objectives achieved by practicing the present invention, reference should be made to the accompanying drawings, which illustrate preferred embodiments of the present invention, and description thereof.

Hereinafter, exemplary embodiments of the present invention will be described in detail in terms of the features and effects thereof with reference to the accompanying drawings. It should be noted that like components will be denoted by like reference numerals throughout the specification and the accompanying drawings.

As used herein, the term "ship" may refer to any type of ship that is provided with a liquefied gas storage tank. For example, the ship may include self-propelled vessels, such as an LNG carrier, a liquid hydrogen carrier, and an LNG regasification vessel (RV), as well as non-self-propelled floating offshore structures, such as an LNG floating production storage and offloading (FPSO) unit and an LNG floating storage regasification unit (FSRU).

In addition, the embodiments of the present invention may be applied to a reliquefaction cycle for any type of liquefied gas that can be transported in a liquid state by liquefaction at cryogenic temperatures and can generate boil-off gas during storage. For example, such liquefied gas may include liquefied petrochemical gas, such as liquefied natural gas (LNG), liquefied ethane gas (LEG), liquefied petroleum gas (LPG), liquefied ethylene gas, and liquefied propylene gas. In the following embodiments, the present invention will be described using LNG, which is a typical liquefied gas, as an example.

A reliquefaction system for ships according to the present invention is a system in which boil-off gas generated from a liquefied gas stored in a storage tank of a ship is discharged through a vapor header, is delivered to a compressor for compression, and is supplied as fuel to an engine of the ship or the like, as needed, and surplus boil-off gas is cooled and reliquefied through heat exchange in a heat exchanger and is returned to the storage tank.

In the reliquefaction system, the boil-off gas generated from the liquefied gas stored in the storage tank of the ship is discharged through the vapor header and is supplied to the compressor along a gas supply line, wherein the gas supply line is connected from the storage tank to the compressor through the heat exchanger, such that uncompressed boil-off gas from the storage tank supplies cold heat to the heat exchanger.

The compressed boil-off gas from the compressor is introduced back into the heat exchanger and is cooled by cold heat from the uncompressed boil-off gas flowing through the gas supply line.

In addition to the uncompressed boil-off gas, the heat exchanger may be supplied with a separate refrigerant circulated along a refrigerant circulation line. The refrigerant circulated along the refrigerant circulation line may be nitrogen, and the refrigerant circulation line may be provided with a refrigerant compressor compressing the nitrogen refrigerant and a refrigerant expander. The nitrogen refrigerant is compressed by the refrigerant compressor, is cooled through the heat exchanger, is expanded and cooled again by the refrigerant expander, and is supplied as refrigerant to the heat exchanger while circulating along the refrigerant circulation line. Accordingly, in the heat exchanger, four different streams, that is, the compressed boil-off gas from the compressor, the uncompressed boil-off gas to be introduced into the compressor, the expanded and cooled refrigerant from the refrigerant expander, and the compressed refrigerant from the refrigerant compressor, participate in heat exchange.

The boil-off gas cooled through the heat exchanger is subjected to gas-liquid separation, and the separated reliquefied gas is returned to the storage tank.

However, introduction of the boil-off gas into the heat exchanger upon start-up of the reliquefaction system or upon changes in temperature of the boil-off gas due to changes in condition of the storage tank can cause thermal stress on the heat exchanger.

In particular, even when the heat exchanger is provided as a cryogenic heat exchanger (CHE), such as a plate-fin cryogenic heat exchanger, which is suitable for the refrigeration cycle using nitrogen and boil-off gas generated from LNG at extremely low temperatures, the heat exchanger is subjected to significant thermal stress since the temperature of boil-off gas generated in the storage tank and introduced into the heat exchanger is usually about −100° C. and, depending on the condition of the storage tank, boil-off gas at a temperature of −130° C. or less can be generated in the storage tank. In particular, when there is a great difference in temperature between the heat exchanger and the boil-off gas, such as when such extremely cold boil-off gas is introduced into the heat exchanger immediately after restart of the reliquefaction system, that is, when the heat exchanger still remains at room temperature or is not yet sufficiently cooled down, thermal stress on the heat exchanger becomes greater, causing damage to the heat exchanger, such as fatigue failure, and reduction in lifespan of the heat changer.

In order to solve these problems, the system according to the present invention includes: a heating line branched off of the gas supply line upstream of the heat exchanger to heat all or some of boil-off gas to be supplied to the heat exchanger and to supply the heated boil-off gas to an upstream side of the heat exchanger, wherein the heating line is provided with a heater to heat the boil-off gas. The heater may be a shell-tube heat exchanger, and a heat source for the heater may include antifreeze, glycol water, and the like.

FIG. 1 is a schematic view of the heater of the reliquefaction system for ships according to the present invention.

Referring to FIG. 1, boil-off gas BOG is heated while passing through the heater 100 and is discharged from the heater 100. The heater is supplied with an antifreeze GW as a heat source for heating the boil-off gas, and the antifreeze cooled while heating the boil-off gas is discharged from the heater. The heater is provided at a bottom thereof with a drain port 110 to drain the antifreeze remaining in the heater to the outside of the heater during maintenance of the heater.

As such, by regulating the temperature of boil-off gas introduced into the heat exchanger through a process in which all or some of boil-off gas from the storage tank is heated by the heater 100, mixed with a boil-off gas stream not passing through the heater 100, and supplied to the heat exchanger, thermal stress on the heat exchanger can be reduced, thereby preventing thermal fatigue of the heat exchanger and damage to the heat exchanger.

However, when such a heater is disposed upstream of the heat exchanger, in the event of leaks at a joint of the heater or in a pipe of the heater, the antifreeze from the heater can be mixed with boil-off gas and enter the heat exchanger, causing internal corrosion of the heat exchanger, reduction in lifespan of the heat exchanger, damage to the heat exchanger, and the like.

In order to prevent these problems, pressure sensors are disposed upstream/downstream of the heat exchanger to detect changes in the state and flow of a working fluid, that is, boil-off gas, such that, upon detection of abnormalities, a controller of the reliquefaction system automatically performs control such as warning, emergency stop, and the like.

However, in the event of small leaks (fine leaks) falling within the measurement error range of the pressure sensor, foreign matter, including the antifreeze, can be continuously introduced into the working fluid while avoiding detection by the pressure sensor, which eventually causes internal corrosion of the heat exchanger, reduction in lifespan thereof, and deterioration in reliquefaction performance thereof.

A micro-leak detection system according to the present invention is intended to detect small leaks in the heater.

Figure 2:
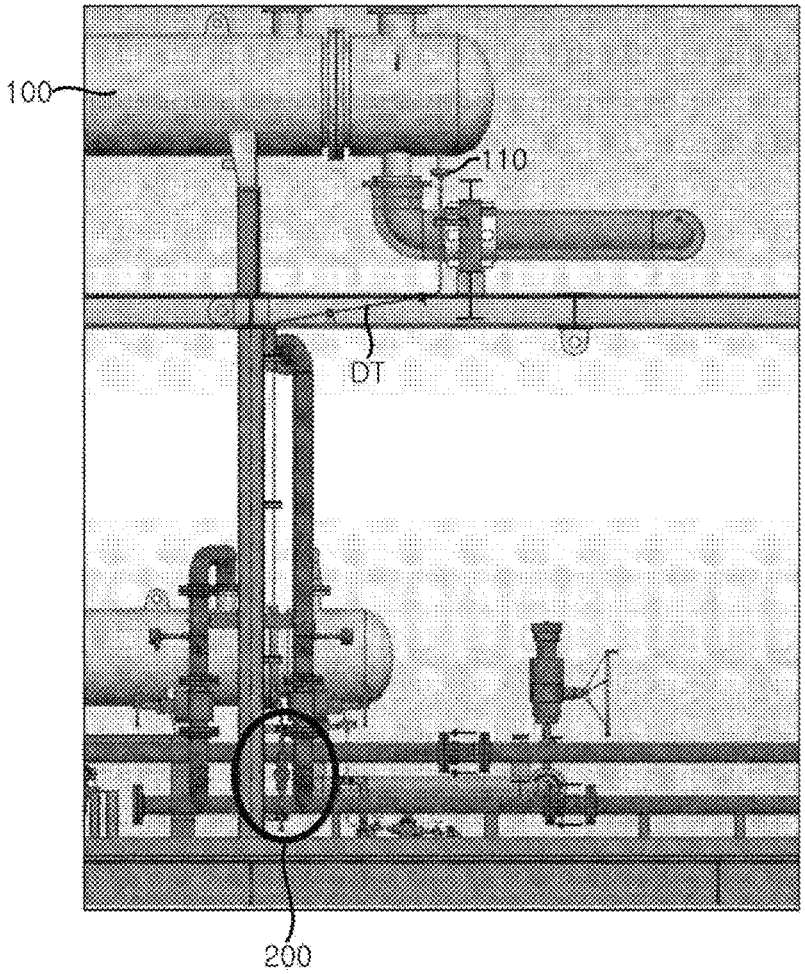
FIG. 2 is a schematic view of a micro-leak detection system of a reliquefaction system for ships according to one embodiment of the present invention.
Figure 3:
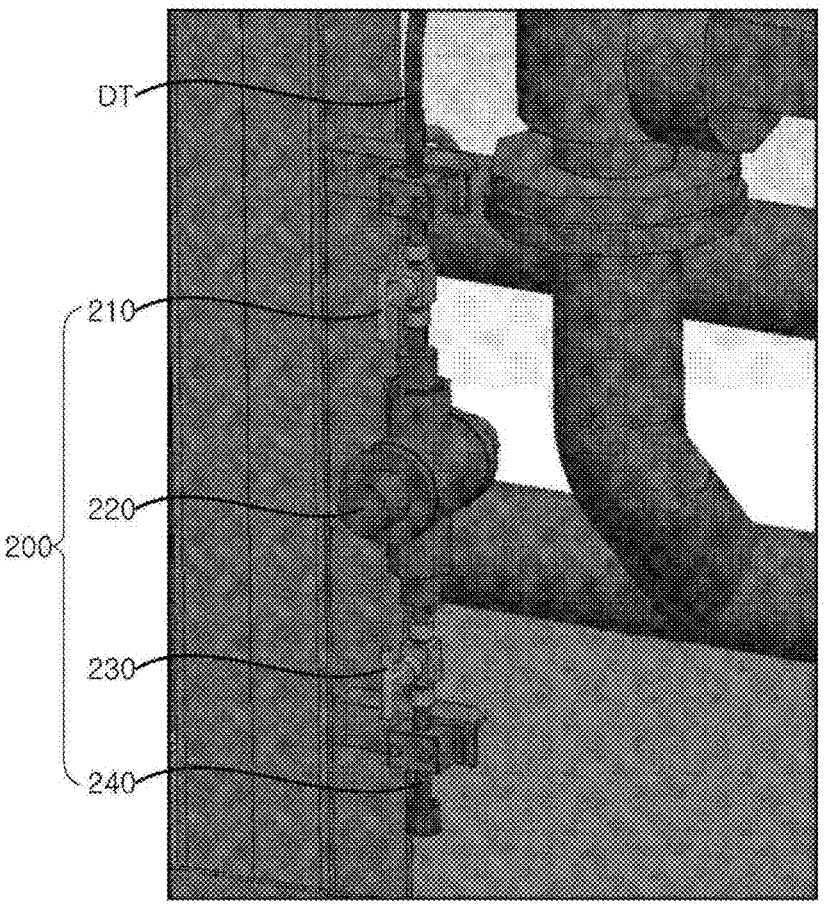
FIG. 3 is an enlarged view of a micro-leak detection device of the system of FIG. 2.

FIG. 2 is a view of a micro-leak detection system of a reliquefaction system for ships according to one embodiment of the present invention, and FIG. 3 is an enlarged view of a micro-leak detection device of the system of FIG. 2.

Referring to FIG. 2 and FIG. 3, a micro-leak detection device 200 for detection of micro-leaks in the heater is connected to a drain port 110 through which a remaining liquid is drained from the heater 100.

The micro-leak detection device 200 includes: a connection tube DT fastened to the drain port 110 and extending downwards therefrom; a leak detection unit 220 provided to the connection tube to detect the presence of the liquid discharged from the drain port; a first shut-off valve 210 disposed on the connection tube at an inlet side of the leak detection unit; a second shut-off valve 230 disposed on the connection tube at an outlet side of the leak detection unit; and a tube plug 240 disposed at a lower end of the connection tube.

By way of example, the leak detection unit 220 may be a sight glass to visually detect the presence of the liquid discharged from the drain port, as shown in FIG. 3. Alternatively, the leak detection unit 220 may be any suitable device that can detect or measure a liquid discharged from the drain port to detect small leaks in the heater, such as a liquid level detector.

In the micro-leak detection device according to this embodiment, the first shut-off valve 210 is operated in a normally open state to continuously monitor the presence of the antifreeze discharged from the drain port due to small leaks in the heater.

In addition, the second shut-off valve 230 is in a normally closed state to allow the leak detection unit 220 to be filled with the antifreeze in the event of small leaks in the heater. However, when the antifreeze remaining in the heater is entirely drained through the drain port 110, such as during maintenance of the heater, the second shut-off valve 230 and the tube plug 240 are opened to drain the remaining liquid from the heater 100 through the drain port 110 and the connection tube DT.

As described above, the micro-leak detection system according to this embodiment can continuously detect small leaks falling within the measurement error range of the pressure sensor disposed upstream/downstream of the heat exchanger, thereby preventing foreign matter, including the antifreeze, from entering the heat exchanger and thus preventing internal corrosion of the heat exchanger and reduction in lifespan of the heat exchanger. As a result, the micro-leak detection system can ensure stable performance of the reliquefaction process and can reduce the frequency of maintenance of the entire reliquefaction system due to device abnormalities or poor reliquefaction performance.

Although some embodiments have been described herein, it will be apparent to a person having ordinary knowledge in the art that the present invention is not limited thereto and may be implemented through various modifications or variations without departing from the technical spirit of the present invention.

The invention claimed is:

1. A micro-leak detection system of a reliquefaction system for ships, comprising:

a reliquefaction system reliquefying boil-off gas generated from a liquefied gas stored in a storage tank of a ship by recovering cold heat from the boil-off gas in a heat exchanger, compressing the boil-off gas, and cooling the compressed boil-off gas in the heat exchanger through heat exchange with a refrigerant circulated along a refrigerant circulation line;

a heater heating the boil-off gas to be supplied from the storage tank to the heat exchanger through heat exchange with an antifreeze liquid; and a micro-leak detection device connected to a drain port through which a remaining liquid is drained from the heater and detecting small leaks in the heater.

2. The micro-leak detection system according to claim 1, wherein the micro-leak detection device comprises:

a connection tube fastened to the drain port and extending downwards therefrom; and a leak detection unit provided to the connection tube to detect the presence of the liquid discharged from the drain port.

3. The micro-leak detection system according to claim 2, wherein the micro-leak detection device further comprises:

a first shut-off valve disposed on the connection tube at an inlet side of the leak detection unit;

a second shut-off valve disposed on the connection tube at an outlet side of the leak detection unit; and a tube plug disposed at a lower end of the connection tube.

4. The micro-leak detection system according to claim 3, wherein the first shut-off valve is operated in a normally open state and the second shut-off valve is operated in a normally closed state, and, during maintenance of the heater, the second shut-off valve is opened to drain the remaining liquid from the heater.

5. The micro-leak detection system according to claim 3, wherein the leak detection unit is a sight glass to visually detect the presence of the liquid discharged from the drain port.

6. The micro-leak detection system according to claim 3, wherein the leak detection unit is a liquid level detector to detect and measure the liquid discharged from the drain port.

7. The micro-leak detection system according to claim 1, ny wherein the heat exchanger is provided as a cryogenic heat exchanger, and the heater is provided as a shell-tube heat exchanger.

* * * * *